US005815968A

United States Patent [19]

Dehli

[11] Patent Number: 5,815,968

[45] Date of Patent: Oct. 6, 1998

[54] DISPLAY APPARATUS HAVING THERMAL COMPENSATION

[75] Inventor: Hans J. Dehli, Dana Point, Calif.

[73] Assignee: Admotion Corporation

[21] Appl. No.: 687,104

[22] Filed: Jul. 22, 1996

[51] Int. Cl.[6] ..... G09F 11/00

[52] U.S. Cl. ..... 40/476; 40/437; 40/509

[58] Field of Search ..... 40/436, 437, 445, 40/470, 476, 488, 508, 509

[56] References Cited

U.S. PATENT DOCUMENTS

| | | | |
|---|---|---|---|
| 1,050,235 | 1/1913 | Scanian . | |
| 1,413,406 | 4/1922 | Huebner . | |
| 2,718,941 | 9/1955 | Robinson . | |
| 2,814,459 | 11/1957 | Hyre . | |
| 3,277,597 | 10/1966 | Trame . | |
| 3,742,631 | 7/1973 | Hasala . | |
| 3,747,243 | 7/1973 | Schneider . | |
| 3,827,797 | 8/1974 | Eaves . | |
| 3,862,504 | 1/1975 | Ringelheim et al. . | |
| 3,883,966 | 5/1975 | Ludwig . | |
| 3,918,185 | 11/1975 | Hasala . | |
| 3,928,846 | 12/1975 | Arai et al. . | |
| 4,092,791 | 6/1978 | Apissomian . | |
| 4,118,879 | 10/1978 | Simon | 40/437 |
| 4,142,794 | 3/1979 | Trump . | |
| 4,159,176 | 6/1979 | De Masi . | |
| 4,185,720 | 1/1980 | Wright, Jr. et al. . | |
| 4,246,713 | 1/1981 | Eckert . | |
| 4,607,472 | 8/1986 | Pointner . | |
| 4,621,443 | 11/1986 | Weinreich | 40/437 X |
| 4,860,471 | 8/1989 | Bonanomi . | |
| 4,864,361 | 9/1989 | Amao et al. . | |
| 4,878,086 | 10/1989 | Isohata et al. . | |
| 4,897,802 | 1/1990 | Atkinson et al. . | |
| 5,035,396 | 7/1991 | Krum et al. . | |
| 5,131,616 | 7/1992 | Biba . | |
| 5,273,249 | 12/1993 | Peterson et al. . | |
| 5,440,214 | 8/1995 | Peters . | |
| 5,459,954 | 10/1995 | Bronaugh et al. | 40/476 |
| 5,513,458 | 5/1996 | Dehli | 40/437 X |

*Primary Examiner*—Brian K. Green
*Attorney, Agent, or Firm*—Fulwider Patton Lee & Utecht, LLP

[57] ABSTRACT

A display device for sequentially displaying a plurality of images interlaced on a single mosaic transparency includes a frame and a drive assembly engageable with the mosaic and operative to drive the mosaic through a closed loop path. A thermal compensation device is mounted on the frame and engaged with a substantially opaque mask overlying the mosaic and formed with a uniform aperture pattern for sequential alignment with the images formed on the mosaic. The thermal compensation device is responsive to temperature changes within the display device to shift the mask relative to the frame such that the mask follows the shifting of the mosaic due to such temperature changes to thereby maintain the mask and mosaic in the proper relative positions for precise registration of the image pixels formed on the mosaic with the apertures in the mask.

28 Claims, 4 Drawing Sheets

DISPLAY APPARATUS HAVING THERMAL COMPENSATION

BACKGROUND OF THE INVENTION

1. Field of the Invention

The present invention relates to advertising displays and, more particularly, to a display apparatus which sequentially displays multiple images formed on a single mosaic transparency.

2. Description of the Prior Art

Advertising is an essential tool which allows various business organizations to convey information concerning their products to consumers. Creating a market worth billions of dollars each year, advertising agencies continually seek new and innovative ways to "deliver their message" to consumers. Business entities are willing to spend such large amounts of money on advertising because consumers often react to effective advertising by seeking out and purchasing the represented products. Thus, the need for product exposure is often critical to the success of a product.

Comprising a small but critical segment of the descriptive product text and graphics are displayed proximate the location of the displayed product itself. Such advertising is often the most effective, and thus important, type of advertising as it often induces consumers to make impulse purchases on the spot.

With the advent of modern display advertising and limited locations for display to high densities of potential customers, a great demand has arisen for display advertising which provides for the display of multiple advertisements at a desirable display location to thereby enable a number of advertisers, rather than just one, to benefit from the premium location. In addition, it is desirable to provide such a device to be utilized in relatively confined spaces, such as immediately adjacent the product display stand itself. This can serve to direct the customer's attention to the advertisement extorting the appealing features of the product in a manner tending to attract attention to the physical product for convenient examination and, hopefully, a successful sale.

Numerous different methods and devices have been proposed for preparing and displaying such advertisements. However, many such devices involve relatively unwieldy mechanical elements driven by complex drive mechanisms which tend to be relatively bulky. Thus such devices will typically be relatively large and expensive to manufacture and therefore not suitable for display in relatively confined areas.

Display devices have been proposed which include generally opaque screens formed with aperture patterns defining various graphics such as numbers, letters or figures to be illuminated by a light source behind such screen. Such devices are disclosed in U.S. Pat. No. 1,172,455 to Hildburgh and in U.S. Pat. No. 4,246,713 to Eckert. However, such devices provide no means for sequentially displaying discrete images or advertisements which cover substantially the entire display screen to allow multiple advertisers to benefit from displaying from a single location.

Prior art devices have also been proposed which include transparent sheets formed with images thereon and which are illuminated by back lighting and cooperate with movable opaque masks including aperture patterns for sequentially registering the aperture pattern with the images formed on the transparent sheet. Examples of such devices are disclosed in U.S. Pat. No. 4,092,791 to Apissomian and in U.S. Pat. No. 3,918,185 to Hasala. However, these devices are not free from shortcomings. In the first place, the devices incorporate relatively complex drive assemblies in order to sequentially align the various images on the sheets with the aperture pattern on the masks. In addition, no means is provided for efficiently adjusting the mask sheet relative to the transparent sheet or for compensating for differences in thermal growth between various portions of such sheets due to differences in temperature.

Yet another device that employs a translucent image screen comprising a mosaic of discrete images formed by relatively small translucent pixels interlaced and arranged in uniform groups for sequential alignment with an aperture pattern formed on a stationary mask is disclosed in U.S. Pat. No. 4,897,802 to Atkinson et al., and assigned to the assignee of the present application. The device exhibits excellent operational characteristics. However, the device is relatively expensive in that it incorporates drive motors mounted at each of the respective corners of the apparatus for displacing the mosaic relative to the grid mask to sequentially display the discrete images formed on the mosaic. In addition, the apparatus disclosed therein provides no means for conveniently adjusting the mask sheet or mosaic sheet relative to one another to maintain alignment of such sheets or compensate for differences in thermal growth between such sheets due to temperature changes.

Still another prior art device designed for sequentially displaying a plurality of images formed on one sheet is disclosed in U.S. Pat. No. 5,440,214 to Peeters, likewise assigned to the assignee of the present invention. The device disclosed in the patent is a low cost, efficient apparatus that provides for the sequential display of multiple high resolution images in a fast and accurate manner. This device, while having been well received commercially, presents some challenge to adjustment and maintenance of alignment during operation thereof in different environments.

Most of the prior art image display devices, such as those described above, are manufactured in relatively compact form so as to be received in very confined locations such as in close proximity to the advertised products themselves. This, coupled with the need for high quality resolution for a viewer viewing from 10–20 feet or so away dictates that the areas of the interlaced image pixels formed on the mosaic and the corresponding apertures in the mask be relatively small. Thus, when dealing with such small dimensions, precise registration across the surfaces of the mosaic and mask sheets becomes critical for optimum performance of the display apparatus. In such devices, a misalignment between any portion of the mosaic and mask on the order of even thousands of an inch can result in a blurred or distorted image being displayed which can annoy the potential purchaser viewing the displayed advertisement rather than inducing the him or her to purchase the product.

Display devices of this type typically utilize electric power to either actuate a motor to displace the mosaic sheet or to actuate a source of back lighting to illuminate the mosaic sheet through the apertures in the mask, or both. Thus, localized internal temperature changes are often experienced in such devices, especially during warm-up periods of such apparatus soon after the device is actuated. In addition, the internal temperature during operation may vary within such an apparatus, being higher adjacent the motor and other components which draw electrical power compared with the other internal areas within the apparatus. Furthermore, such apparatus are often mounted in a vertical orientation. As such, air heated by the motor and/or light source will tend to rise thus tending to raise the temperature toward the top of the device to a higher temperature than that at the bottom of the device.

Thus, temperature changes to which certain components in such a device are exposed may cause such components to expand or contract in response to the changes in temperature. Because the components are often formed of different materials having different coefficients of thermal expansion, they may tend to expand or contract at different rates even when subjected to the same temperature variations. In addition, as described above components disposed in different locations will experience different temperatures and will thus expand or contract to different degrees. Thus, the various components may tend to shift relative to each other resulting in the entire surfaces of the mask and mosaic mounted on such components or portions thereof being shifted out of alignment with one another such that less than a complete image or portions of multiple images are displayed through the apertures in the mask. This is a problem not addressed or solved in any of the prior art devices discussed above.

As such, it will be appreciated that there continues to be a need for a display device for sequentially displaying multiple images from a single mosaic which is inexpensive to manufacture, provides for convenient and easy manual alignment of the mask and mosaic, and which provides thermal compensation means to maintain the mask and mosaic in proper relative positions during periods of temperature changes experienced inside the device. The present invention addresses these needs and others.

SUMMARY OF THE INVENTION

Briefly, and in general terms, the present invention is directed to a display apparatus for sequentially displaying multiple images formed on a transparent mosaic through a substantially opaque mask and which provides an adjustable thermal compensation assembly for automatically maintaining the mosaic and mask in proper spacial relation relative to one another during periods of temperature change. The apparatus includes a frame assembly on which is mounted a drive assembly configured for releasable engagement with the mosaic and operative to, in the preferred embodiment, drive the mosaic through a predetermined closed loop path to sequentially register the sets of image pixels on the mosaic with the apertures formed in the mask. An adjustable thermal compensation device is connected to the frame assembly and is configured for releasable engagement with the mask to mount the mask on the frame over the mosaic. The thermal compensation device is responsive to changes in temperature to expand or contract accordingly and displace the mask to correspond with displacement of the mosaic resulting from the changes in temperature so as to compensate for the shifting of the mosaic to thereby maintain the mask in the proper position relative to the mosaic.

Other features and advantages of the present invention will become apparent from the following detailed description, taken in conjunction with the accompanying drawings which illustrate, by way of example, the features of the invention.

DETAILED DESCRIPTION OF THE PREFERRED EMBODIMENT

Figure 1:
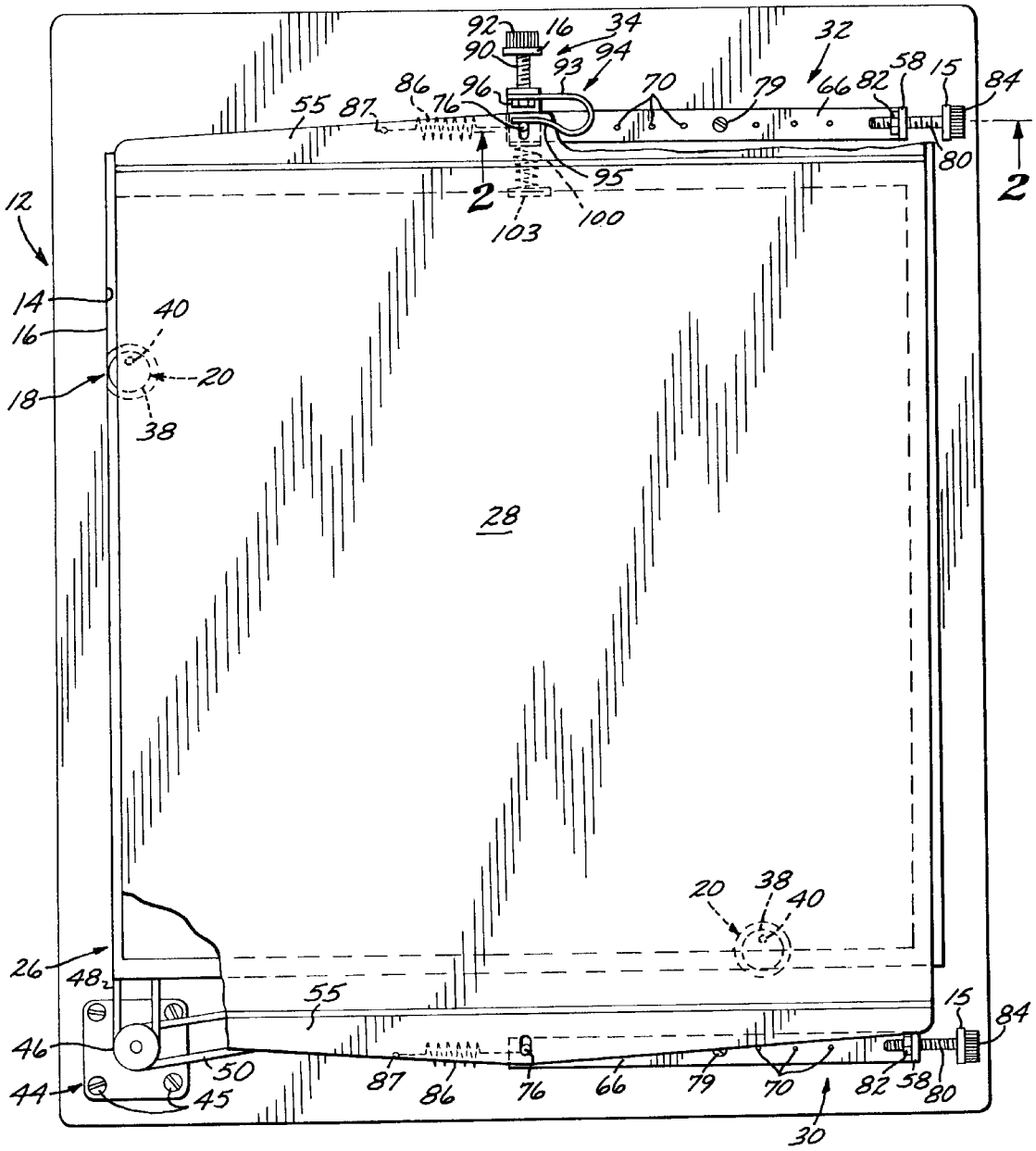
FIG. 1 is a partially fragmented top plan view of a display apparatus incorporating a thermal compensation assembly embodying the present invention.

In the following detailed description, like reference numerals will be used to refer to like or corresponding elements in the different figures of the drawings. Referring now the drawings, and particularly to FIG. 1, there is shown a display apparatus, generally designated 10, which is shown and described herein because it incorporates certain features of the present invention. Thus the display apparatus shown and described herein illustrates one particular embodiment of a device with which the thermal compensation assembly of the present invention may be employed. The display apparatus is intended to, in certain applications, be suspended in a vertical orientation as shown in FIG. 1 facing the audience. It incorporates a generally rectangular frame 12 defining a central window 14 into which is mounted a generally square shaped, transparent or translucent platen 16 which provides for projection therethrough of light from a source of back lighting disposed behind the platen (not shown). Mounted in spaced apart relation on the frame are respective eccentric drives, generally designated 18 and 20, which are rotatably mounted on the frame and formed with upwardly opening, eccentrically disposed mounting bores 22 and 24. The eccentric drives mount thereon a translucent mosaic sheet, generally designated 26, and are operative to displace the mosaic sheet through a predetermined closed loop path relative to a mask sheet, generally designated 28, as described in greater detail below. The respective eccentric drives are engaged to and driven by a motor, generally designated 44, mounted adjacent one corner of the frame 12. The mask sheet overlies the mosaic sheet and is maintained in a generally stationary position by means of a pair of vertically spaced apart, laterally extending thermal compensation arm devices, generally designated 30 and 32, and a screw and bracket adjustment assembly, generally designated 34, which serves to set a base vertical position for such mask.

Figure 7:
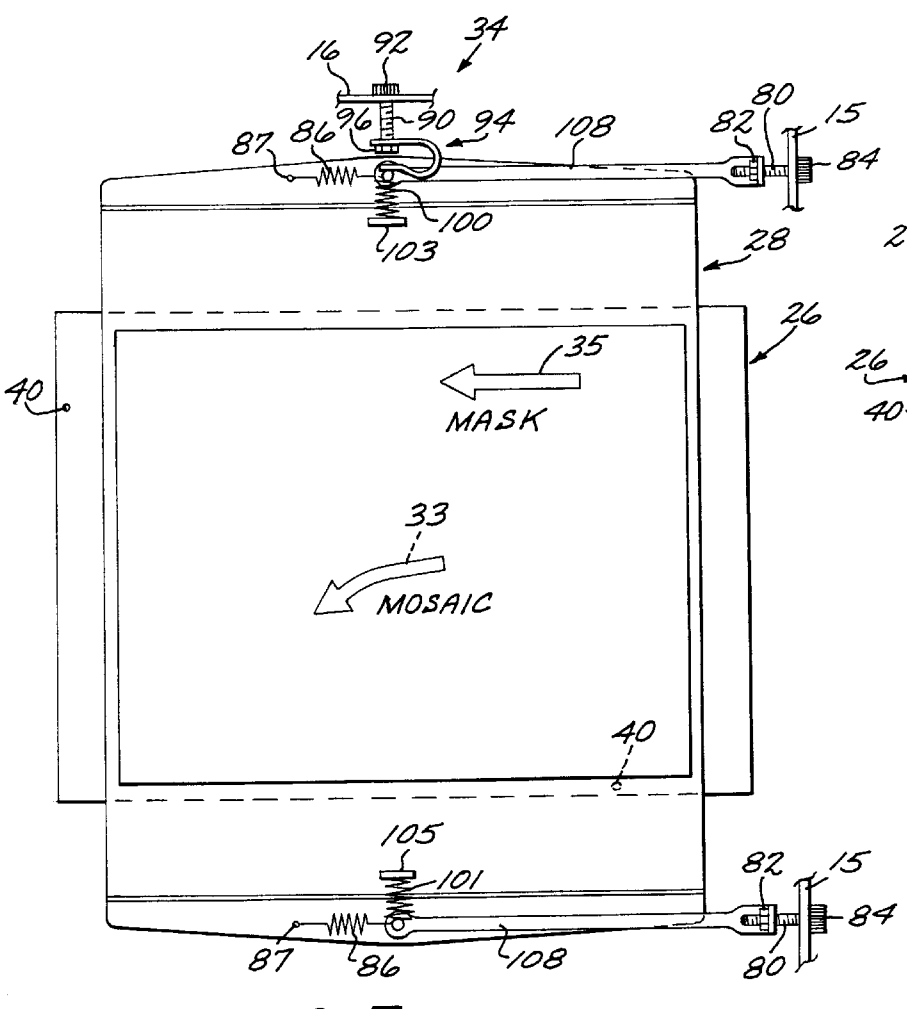
FIG. 7 is a schematic drawing illustrating shifting of the mask and mosaic when subjected to temperature changes in a display apparatus not including the thermal compensation assembly of the present invention.

The prior art display apparatus fail to address the problems associated with misalignment between the mask 28 and mosaic 26 resulting from temperature fluctuations experienced inside such apparatus. Referring to FIG. 7, there is shown schematically the shifting tendencies of a mosaic 26 employed in currently available commercial devices as it grows due to heating and shifts relative to the mask 28. Such prior art apparatus typically include at least two somewhat articulated conventional horizontal tethering arms 108 formed integrally of either a metal or plastic. Such arms are typically anchored at the respective one ends to the frame by anchor brackets 15 and connect at respective opposite ends to the mask so as to provide for floating movement of such mask as dictated by respective adjustment screws 84 and 92.

In this manner initial registration of the mask 28 relative to the mosaic 26 may be obtained by adjusting the relative position of such mask by adjusting such screws 84 and 92. In operation the mosaic 26 is hung on eccentric drive pins 40 located toward the respective upper left and lower right corners of the apparatus and which serve to orbit such mosaic through a circular path to be stopped momentarily at predetermined locations in each of the four quadrants to momentarily align the respective discrete image portions with the respective apertures (not shown) in the mask. As will be appreciated by those skilled in the art, since the mosaic 26 has a positive coefficient of thermal expansion it will, when heated, tend to grow thus tending, to a great extent, to expand in a predetermined path downwardly away from the upper left eccentric drive pin 40 and to the left from the lower right drive pin 40. This then tends to cause the lower left area of such mosaic to shift generally down and to the left as depicted by the directional arrows 33. In contrast, such a temperature rise will cause the tether arms 108 to respond uniformly thus shifting the mask 28 laterally to the left as viewed in FIG. 7 and depicted by the directional arrow 35. Thus, it will be appreciated that the mask apertures and mosaic image portions, particularly in the lower left area, will no longer be in the proper relative positions and thus as the mosaic is driven through the closed loop path by the drive assembly, the sets of image pixels in the lower left area will not properly register with the aperture pattern, thus resulting in a blurred or distorted image being displayed by the display apparatus.

Figure 8:
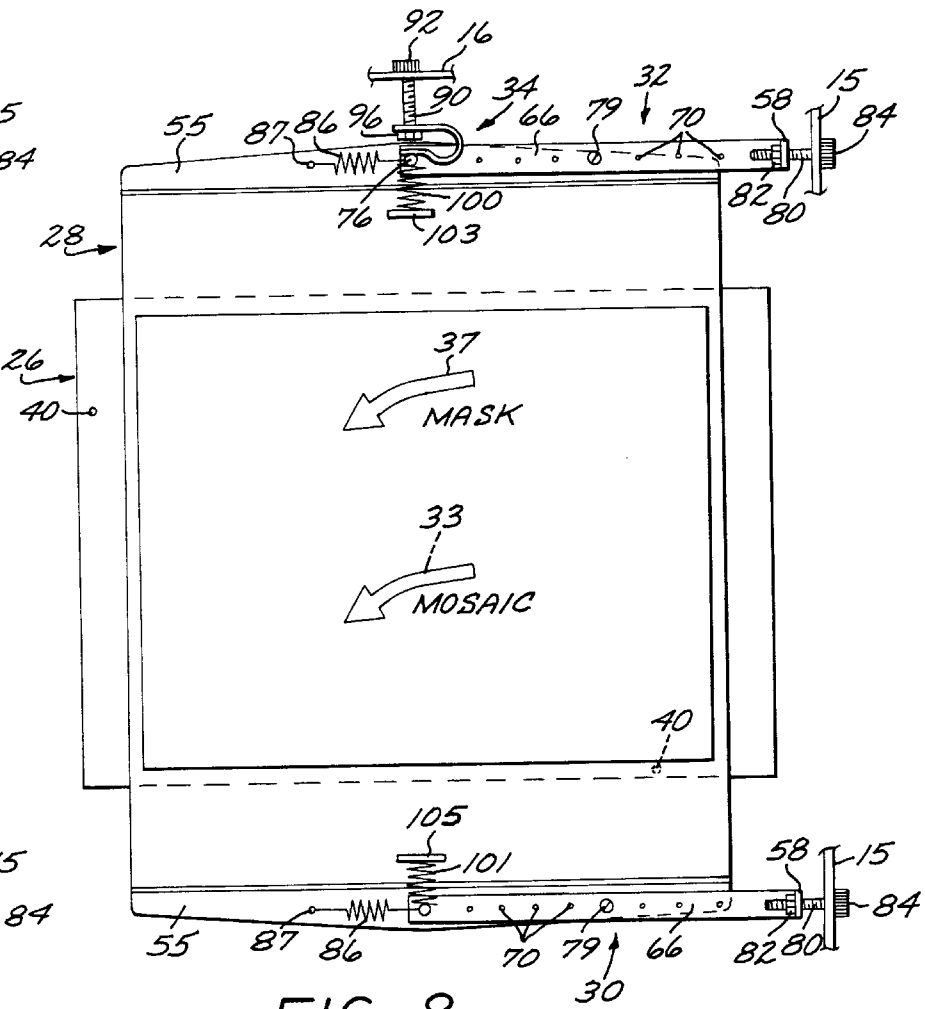
FIG. 8 is a schematic drawing illustrating shifting of the mask d mosaic when subjected to temperature changes in a display apparatus including the thermal compensation assembly of the present invention.

In light of the above-described adverse operational characteristics, the display device of the present invention incorporates the pair of adjustable thermal compensation arm devices 30 and 32 to mount the mask 28 in overlying relationship over the mosaic sheet 26 (FIG. 1). As will be described in greater detail below, the adjustable thermal compensation arm devices of the present invention serve to maintain the mask and mosaic in the proper relative positions during periods of temperature changes by shifting the mask downwardly and to the left at a rate corresponding with the temperature change as depicted by the directional arrow 37 to follow the predetermined path of the mosaic, as depicted by the directional arrow 33 (FIG. 8).

The mosaic film sheet 26 in the preferred embodiment comprises a plurality of pixels of discrete images interlaced with pixels of other discrete images in a uniform pattern over the entire area thereof. In this embodiment, the pixels are formed with a rectangular configuration and the mosaic is formed with four such discrete images interlaced thereon. As will be appreciated by those skilled in the art these pixels may take many different configurations such as round, triangular, rectangular or other polygonal shape. Furthermore, the pattern of relative travel may be, for instance oval, triangular or even reciprocal along a linear path to provide for repetitive shifting to two or more locations along the linear path. The mosaic sheet is formed adjacent the diagonally opposite corners thereof with a pair of spaced apart follower bores 35 to receive respective mounting pins 40 of the respective eccentric drives 18 and 20 therethrough to mount the mosaic sheet thereon. The images are sequentially displayed by relative movement between the mosaic sheet and mask sheet 28 so that the aperture pattern formed on the mask sheet is sequentially registered with the image pixel sets corresponding with the discrete images. The source of back lighting serves to illuminate those image pixels in registration with the apertures in the mask to display the corresponding image.

Figure 6:
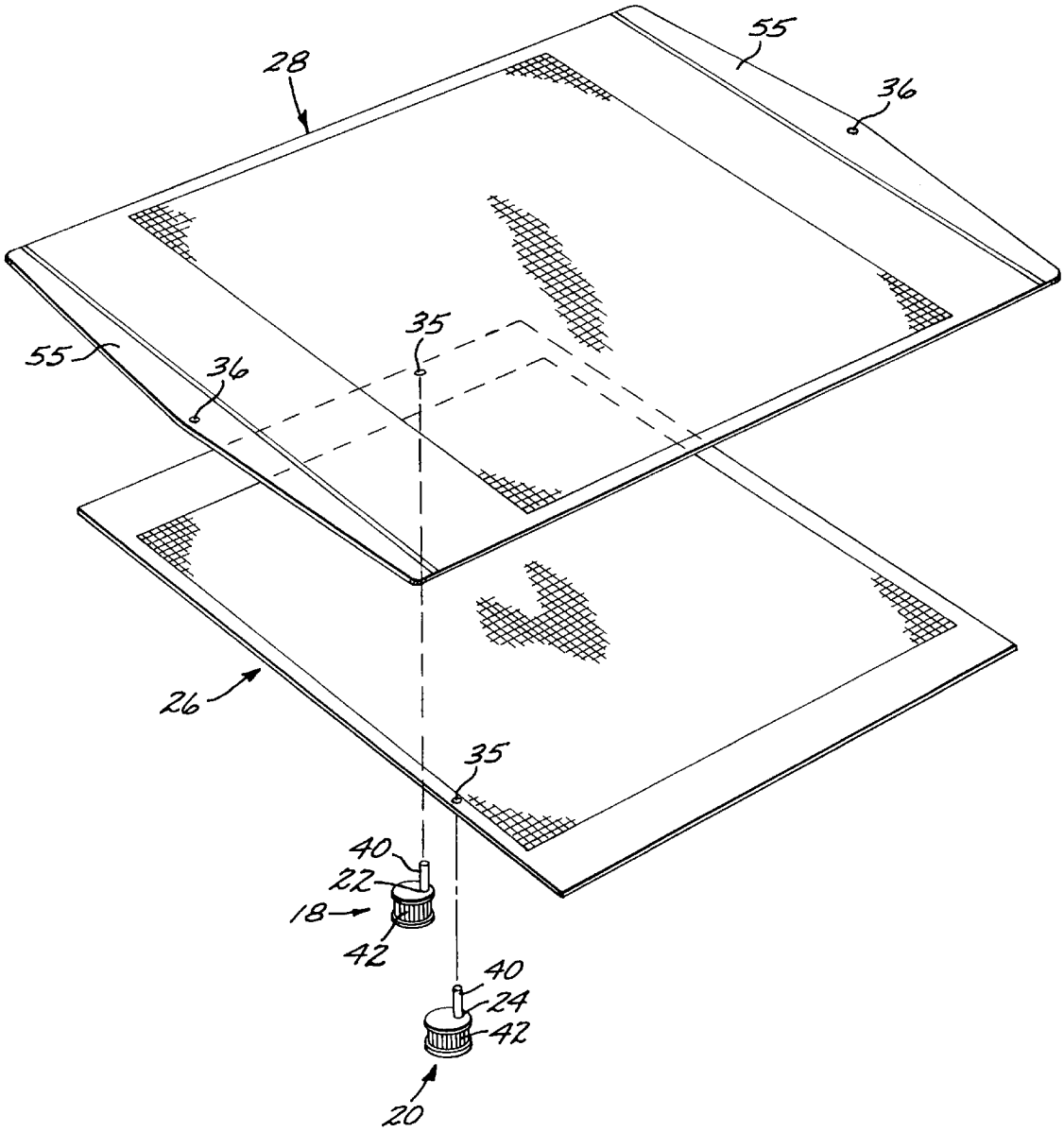
FIG. 6 is an exploded perspective view of the mask and mosaic and a pair of eccentric drives included in the present invention.

The mask sheet 28 is generally rectangular in cross-section and is formed of a plurality of spaced apart horizontal and vertical opaque strips which are uniformly spaced thereon to form a uniform aperture pattern on the mask. The dimensions of the apertures correspond with the dimensions of the image pixels on the mosaic 26. Referring to FIG. 6, the mask is formed having a pair of mounting bores 36 formed centrally at the opposite longitudinal ends thereof for releasably mounting the mask sheet to the respective thermal compensation arm devices 30 and 32 as described in greater detail below.

Referring to FIG. 1, the frame 12 is generally rectangular in cross-section and is formed centrally with a generally square shaped cut-out defining the window 14. Mounted at the top and bottom of such frame along one side thereof are a pair of upstanding anchor brackets 15 (FIG. 1) to mount the laterally projecting thermal compensation arm devices 30 and 32 and a bracket 16 is disposed at the top of the frame to mount the screw and bracket assembly 34 (FIG. 2) thereto as described in greater detail below.

The platen 16 is generally of rectangular configuration, securely mounted in the window 14 of the frame 12, and formed with a sturdy transparent or translucent surface with a pair of circular in cross-section, upwardly opening wells 38 disposed adjacent the upper left and lower right corners thereof for nesting therein of the respective eccentric drives 18 and 20 therein. Respective upstanding mounting stems (not shown) are formed in the respective wells and are received in respective downwardly opening bores (not shown) formed in the eccentric drives into which are press fit bushings to provide for free rotation of the eccentric drives on the respective mounting stems.

The respective eccentric drives 18 and 20 are in the form of cylindrical heads carried from the respective mounting stems and formed in their upwardly facing ends with eccentrically disposed bores off-set from the center of the drive by a distance corresponding with one-half the cross-sectional dimension of the pixels formed on the mosaic 26. Press fit into the respective eccentric bores are ball bearing assemblies (not shown). Press fit into the respective inner races of the bearing assemblies are the respective upstanding eccentrically located drive pins 40 which, due to the nature of the ball bearing assemblies, may rotate about their own axes independent of the eccentric drives. Formed in the periphery of the respective eccentric drives at the bottom thereof are respective toothed grooves 42 (FIG. 6) which mesh with the teeth of respective drive belts as described in greater detail below.

The respective mounting pins 40 (FIG. 1) are sized for making a close fit in the respective diagonally opposed follower bores 35 (FIG. 4) formed in the mosaic sheet 26 to thereby mount the mosaic on the respective eccentric drives 18 and 20. Thus as the eccentric drives are rotated, the respective mounting pins serve to drive the mosaic sheet through a predetermined closed loop path relative to the mask sheet 28 to sequentially register the sets of image pixels with the apertures formed in the mask.

While the eccentric drives 18 and 20 are shown in the figures engaged with the mosaic 26 and the thermal compensation arm devices 30 and 32 are shown engaged with the mask 28, it will be appreciated that the mosaic could be mounted on the compensation arms to remain generally stationary and the mask mounted on the eccentric drives to be driven through a closed loop path relative to the mosaic to sequentially register the apertures in the mask with the sets of image pixels formed on the mosaic.

Referring to FIG. 1, the motor 44 is mounted on the frame 12 at the lower left corner thereof by means of a plurality of screws 45 which extend through bores formed in the motor body to engage respective threaded bores formed in the frame 12. A motor drive shaft (not shown) extends upwardly from the motor body and is non-rotatingly engaged with a double grooved drive pulley 46. The drive pulley is formed with a pair of toothed peripheries for engaging respective drive belts 48 and 50 which run on the respective toothed peripheries 42 of the eccentric drives 18 and 20. Thus, actuation of the drive motor causes the drive shaft and thus the drive pulley to rotate, and such rotation is then imparted on the respective eccentric drives via the respective drive belts.

The drive motor 44 may be of many different types. By way of example, the motor could be embodied as a stepper motor such as the type disclosed in U.S. patent application Ser. No. 08/153,127, filed Nov. 15, 1993, and now U.S. Pat. No. 5,513,458, assigned to the assignee of the present invention, and incorporated herein by reference. A control circuit (not shown) may be included and electrically connected to the stepper motor to stop the motor at predetermined dwell points corresponding with the precise registration of the sets of image pixels formed on the mosaic sheet 26 with the aperture pattern formed in the mask sheet 28. The dwell points are each separated by 90° along the 360° closed loop circuit. The control circuit is responsive to a predetermined number of steps of the motor to deactivate the motor for a predetermined amount of time to display the registered image through the aperture pattern. After such predetermined amount of time has elapsed, the control circuit automatically reactuates the motor to advance another 90° to the next predetermined dwell point. This process is continued to sequentially display the discrete images formed on the mosaic sheet.

In addition, the drive motor could comprise a conventional AC or DC motor controlled by a timing circuit to dwell at predetermined dwell points, such as those systems shown in corresponding patent application Ser. Nos. 08/602,980 and 08/602,984, both filed on Feb. 16, 1996, and now U.S. Pat. Nos. 5,783,919 and 5,767,650, assigned to the assignee of the present invention. As such, it will be appreciated that many different drive assemblies may be used with the present invention to sequentially display the multiple images formed on the mosaic and that the present invention is not intended to be limited to one particular drive assembly.

Figure 2:
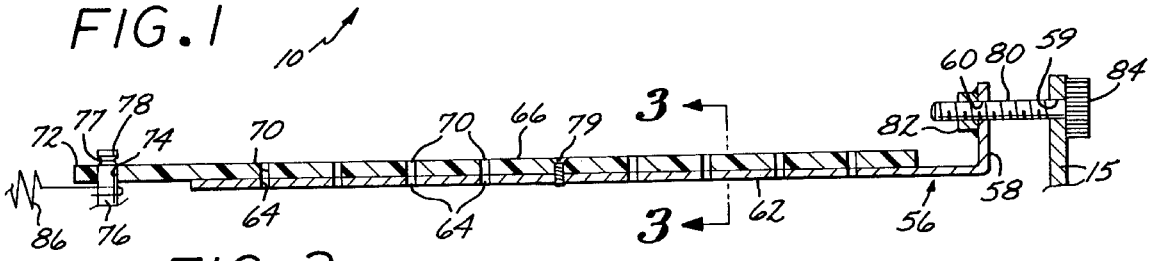
FIG. 2 is a cross-section view, in enlarged scale, taken along the line 2—2 of FIG. 1.

Referring to FIGS. 1, 2 and 6, the mask 28 includes at its upper and lower ends respective stiffener strips 55 formed centrally with the respective mounting bores 36.

Figure 3:
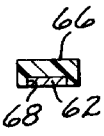
FIG. 3 is a cross sectional view taken along the line 3—3 of FIG. 2.

Referring to FIGS. 1 and 2, and particularly to FIG. 2, the thermal compensation arm devices 30 and 32 are identical in configuration and thus the following description of the arm device 32 applies as well to the arm device 30. As shown in FIG. 2, the arm device 32 is of generally linear construction and comprises a metallic bar 56 constructed of, for instance, steel, anchored at one end to the anchor bracket 15 and arranged on its distal end in telescopic relationship with an overlying nylon bar 66 releasably connected at its distal end with the mounting bore 36 by means of a mask anchor pin 76. The bar 56 is formed with a linear strap of metal 62 configured at its proximal end with an orthogonal, upstanding flange 58 formed with a through bore 60 and having a threaded nut 82 fixedly engaged therewith in alignment with such bore. Such strap 62 is formed with a plurality of longitudinally spaced apart threaded registration bores 64. The overlying nylon bar is in the form of an elongated nylon strip 66 configured with a downwardly opening longitudinal slot 68 (FIG. 3) having the linear strap of the metallic bar 56 nested in telescopic relationship therein. The nylon strip is likewise formed with a plurality of bores 70 arranged in spaced relationship to cooperate with the spacing of the bores 64. The steel strap and nylon strip may be telescoped longitudinally to the desired degree of overlap to align the corresponding bores formed in the respective steel strap and nylon strip for threaded engagement with a control screw 79 to join the steel strap and nylon strip and to dictate the extent of overlap necessary to provide the combined magnitude of thermal expansion desired. Thus the nylon strip and steel strap cooperate to provide a hybrid coefficient of thermal expansion for the entire arm device dictated by the placement of the control screw 79 which controls the active length of the nylon strip disposed to the left of such screw and the active length of steel strap to the right thereof. Such nylon strip terminates at its distal end in a mounting ring 72 formed with a vertically extending bore 74 for telescopic extension therethrough of a mask anchor pin 76 configured with a central body for press fit therein. The mask pin is formed on its forwardly projecting end with a groove 77 and an enlarged in diameter head 78 (FIG. 2) having a cross-sectional dimension slightly larger than the width of the mounting bores 36 formed in the mask 28. As such, the mask pins may be extended through the respective mounting bores in the mask and press fit into the vertical bores formed in the mounting rings until the respective heads rest on top of the mask sheet to securely mount the mask sheet over the respective thermal compensation arm devices.

Referring to FIGS. 1 and 2, the orthogonal flanges 58 of the thermal compensation arm devices 30 and 32 are formed with respective bores 60 for receipt of the freely rotatable adjustment thumb screws 80 telescopically extended through respective bores 59 formed in the spaced apart anchor brackets 15 to engage respective threaded nuts 82 welded to the back side of the respective flanges. The adjustment screws are formed at their respective laterally outer ends with knurled thumb knobs 84 which abut against the laterally outwardly facing surfaces of the respective anchor brackets. Thus rotation of the respective knobs serves to displace the thermal compensation arm devices relative to the upstanding anchor brackets and thus displaces the mask sheet 28 relative to the mosaic sheet 26. As such, the adjustment screws provide a means for manual adjustment of the mask in the lateral direction relative to the mosaic, such as before the device is actuated to allow for initially positioning the mask in the proper position relative to the mosaic.

The coefficient of expansion for nylon is greater than that for steel, expanding approximately seven times more than steel when subjected to the same temperature increase. Thus it will be appreciated that the magnitude of expansion experienced by the thermal expansion control arm devices 30 and 32 during temperature changes is adjustable simply by changing the position of the control screw 79 to engage different adjustment bores 64 and 70. It will be appreciated that by moving the control screw into engagement with adjustment bores closer to the mask pin 76, the magnitude of expansion of the arms will be reduced as a result of the active length of the nylon strips 66 between the mask pin and the control screw being reduced. Conversely, if the screw is moved to into engagement with adjustment bores further away from the mask pin, the arm will expand to a greater degree as a result of a relatively greater active length of nylon being incorporated in the composite active arm.

As will be apparent to those skilled in the art, the appropriate rate of thermal expansion for the respective composite arm 30 or 32 may thus be conveniently selected by changing the position of the respective control screws 79 to cause the respective top and bottom of the mask to be shifted laterally and upwardly or downwardly relative to the frame to a degree sufficient to compensate for the degree to which the respective top and bottom of the mosaic is shifted as a result of thermal expansion or contraction stemming from temperature changes experienced within the display device.

Figure 4:
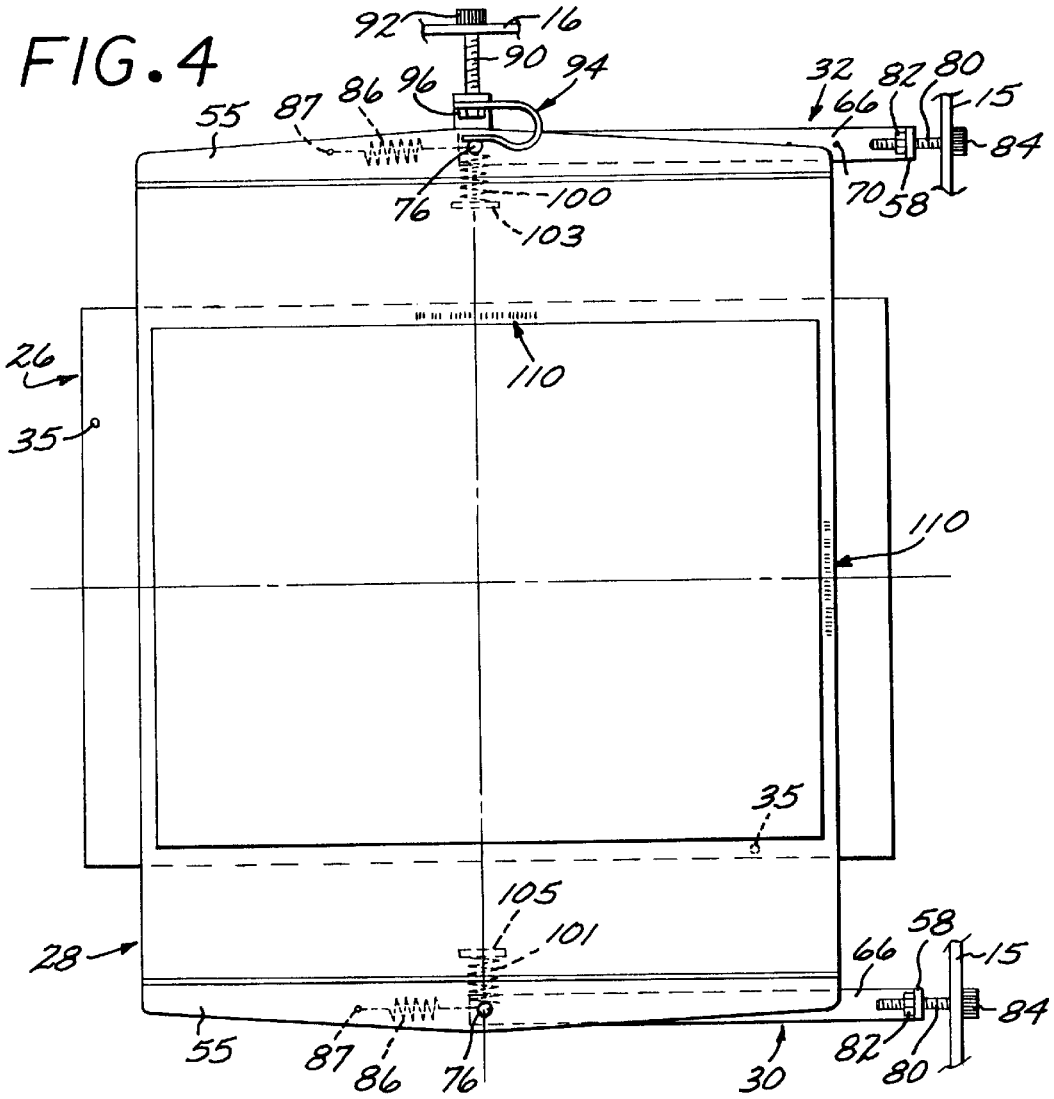
FIG. 4 is a partially fragmented top plan view of a mask sheet, mosaic sheet and a plurality of thermal expansion control arms included in the present invention.

With continued reference to FIG. 1, the mask anchor pins 76 project rearwardly of the respective nylon rings 72 and respective coil tension springs 86 are anchored on their respective one ends to the frame 12 and are hooked at there respective free ends to the respective mask anchor pins to bias the respective ends of the control arm devices to the left as viewed in FIGS. 1 and 4 against the adjustment applied by the respective thumb screws 84.

Referring to the top of FIG. 1, the bracket adjustment device 34 serves to provide a downward bias on the upper mask anchor pin 76. The bracket adjustment device includes a threaded thumb screw 90 formed at one end with a knurled adjustment knob 92. The screw is telescopically extended through a bore (not shown) formed in the upstanding anchor bracket 16 and through a bore formed in an upper arm 93 of a generally hairpin shaped leaf spring, generally designated 94, for threaded engagement with a threaded nut 96. The lower arm 95 of the leaf spring abuts against the upper mask anchor pin 76 and biases such pin downwardly. Thus it will be appreciated that adjustment of the adjustment screw 90 will serve to displace the upper arm of the biasing spring relative to the mask pin and thereby adjust the magnitude of the downward bias applied by the biasing bracket to the upper mask pin.

Referring to FIGS. 1, 4 and 8, a pair of upper and lower coil compression springs 100 and 101 are interposed, respectively, between a laterally extending upper anchor post 103 mounted on the frame 12 and the upper mask anchor pin 76, and a lower anchor post 105 mounted on the frame 12 and the lower mask anchor pin 76 to cooperate in pushing the respective anchor pins apart to stretch the mask sheet 28 and drawing such sheet onto the mosaic.

Referring to FIG. 8, there is illustrated the movement of the mask 28 and mosaic 26 during temperature changes with the mask mounted on the display apparatus by means of the thermal compensation arm devices 30 and 32 of the present invention and with such arms adjusted to the proper positions by means of the control screws 79 being engaged with the proper bores 64 and 70.

In order to provide the shifting of the mask sheet 28 downwardly and to the left as depicted by the directional arrow 37 in FIG. 8, it will be necessary for the upper compensation arm 32 to expand at a faster rate than the lower compensation arm 30. Thus the control screw 79 may be set in the appropriate bores 64 and 70 on the upper arm 32 at a predetermined position, and the control screw set in the appropriate bores 64 and 70 in the lower arm 30 at a position relatively closer to the mask anchor pin 76 compared with the position of the screw on the upper arm 32. As such, the nylon strip 66 of the upper arm will present a relatively longer active length free to expand, and thus will expand to a greater degree than will the lower arm device 30 when subjected to an increased temperature. With such a configuration, it will be appreciated that the mask sheet will be shifted to the left and downwardly in somewhat of an arc when the compensation arms are subjected to temperature increases so as to cause the mask to track the corresponding travel of the mosaic and maintain them in registration with one another. In practice, the placement of such screws 79 is typically set at the factory to provide the relative rate of expansion and contraction desired for the expected environment in which the device is to operate. Then, the user may adjust the location of such screws as necessary to cause the path 37 of the mask to track that 33 of the mosaic for the particular temperature differentials experienced.

Figure 5:
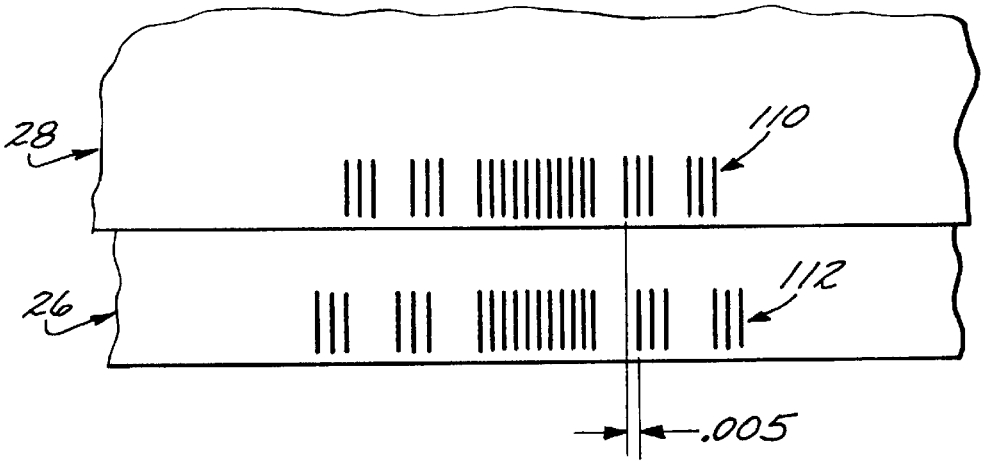
FIG. 5, is a fragmented view, in enlarged scale, of alignment indexing indicia formed on the mask and mosaic shown in FIG. 4.

Referring to FIG. 5, there is shown respective indexing indicia 110 & 112 formed on the mask 28 and mosaic 26 respectively at predetermined positions thereon and which a user may observe to determine the degree of misalignment between the mask and mosaic. The line groups comprise elongated apertures formed in the mask and mosaic and uniformly spaced 0.005 inches apart. With the mask in place overlying the mosaic, the respective alignment apertures on the mask and mosaic will be back lit when they are in registration with each another. Thus, as shown by way of example in FIG. 5, if the alignment line groups, as a result of changing temperatures, display a shift of one line section, corresponding with a shift of the mosaic relative to the mask of 0.005 inches, the user may change the positioning of one or both of the control screws 79 accordingly to alter the expansion characteristics of the respective thermal compensation arm or arms to displace the mask relative to the mosaic and bring it into proper alignment with the mosaic.

In operation, the user may select a mosaic sheet 26 comprising the desired images to be displayed and place such sheet in overlying relation on the platen 16. The follower bores 35 formed in the mosaic sheet are extended downwardly over the respective upwardly projecting drive pins 40 of the eccentric drives 18 and 20. The user may then mount the mask sheet 28 over the mosaic sheet by aligning the top and lower mounting bores 36 formed in the mask sheet with the vertical bores 74 formed in the respective thermal compensation arm devices 30 and 32 and extending the mask pins 76 therethrough. The user may then adjust one or more of the adjustment knobs 84 and 92 as necessary to displace the mask relative to the mosaic to bring the apertures into registration with one of the sets of image pixels formed on the mosaic.

The user may then actuate the motor 44 to rotate the eccentric drives 18 and 20 and thus displace the mosaic through the predetermined closed loop path to sequentially register the sets of image pixels with the aperture pattern in the mask 28. The motor will be temporarily deactivated at predetermined dwell points corresponding with the precise registration of the apertures with the sets of image pixels, such as by utilizing the stepper motor or control circuitry as described above.

During periods of temperature changes, the mosaic 26 will typically tend to shift downwardly and to the left as a result of the increased temperature. Likewise, the pre-set thermal expansion control arms 30 and 32 are responsive to the increased temperature to expand accordingly so as to shift the mask sheet 28 mounted thereon downwardly and to the left to follow the shifting of the mosaic and maintain the proper relative spacing therebetween. Thus as the eccentric drives continue to displace the mosaic through the closed loop path, the sets of image pixels will continue to be precisely registered with the apertures in the mask to sequentially display the respective images in their entirety. The reverse will be true when the temperature drops.

Since the relative active lengths of both the nylon and metal arms may be adjusted for both the upper and lower control arm devices 30 and 32, a great degree of adjustment is available to be assured that the temperature induced path 37 of the mask relative to the mosaic may be made to precisely follow the temperature induced path 33 of such mosaic for a great variety of temperature ranges in which the display apparatus might be operating.

If, during periods of temperature change, the mask 28 and mosaic 26 should happen to become misaligned, the user may simply observe the alignment indicia 110 and 112 to determine the degree of misalignment and then change the position of one or both of the control screws 79 accordingly to change the length of nylon free to expand, thereby displacing the mask sheet relative to the mosaic to bring the mask and mosaic into proper relative positions.

From the foregoing, it will be appreciated that the present invention provides a relatively simple apparatus for sequentially displaying a plurality of images from the one apparatus. Furthermore, the present invention provides an adjustable thermal compensation assembly to maintain the mask and mosaic in proper relative positions during periods of temperature changes.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A display apparatus comprising:

discrete images comprised of sets of image pixels interlaced on a transparent mosaic sheet and registered against a substantially opaque mask sheet formed with an aperture pattern comprising a plurality of uniformly spaced apart apertures wherein one of said sheets comprises a movable sheet and other of said sheets comprises a generally stationary sheet, said movable sheet mountable by at least one selected point to a drive device and having a coefficient of thermal expansion causing at least a portion thereof in response to exposure thereof to predetermined temperature differentials to move through a temperature induced path relative to said generally stationary sheet;

a frame assembly;

said drive device being mounted on said frame assembly, and operative to displace said movable sheet through a predetermined travel path relative to said generally stationary sheet to sequentially align said sets of image pixels with said aperture pattern; and at least one elongated thermal compensation arm device including an elongated strip having a first coefficient of thermal expansion and a first relative active length and an elongated strap having a second coefficient of thermal expansion and a second relative active length telescopically connected together to form a composite thermal compensation arm device having a hybrid coefficient of thermal expansion and further including a first end engaged with said frame assembly and a second end formed for releasable engagement with said generally stationary sheet, said composite thermal compensation arm device being responsive to said predetermined temperature differentials to cause said at least a portion of said generally stationary sheet to be shifted by said composite thermal compensation arm device through a path corresponding to said predetermined temperature induced path to maintain said mask sheet and said mosaic sheet in proper relative positions for continued sequential alignment of said sets of image pixels with said aperture pattern.

2. The apparatus of claim 1 wherein:

said frame assembly includes an upstanding anchor bracket; and said composite thermal compensation arm device engages said bracket.

3. The apparatus of claim 1 wherein:

said strap comprises a metallic strap and said strip comprises a nylon strip, said metallic strap and said nylon strip being connected together to form proportionate portions of an overall length.

4. The apparatus of claim 1 wherein:

said composite thermal compensation arm device comprises a first composite thermal compensation arm device, and further including;

a second composite thermal compensation arm device spaced apart from said first composite thermal compensation arm device and forming a pair of said composite thermal compensation arm devices for connection with said mask sheet at spaced apart locations, to, upon exposure thereof to said temperature differentials, cause said spaced apart locations to be moved relative to said frame assembly respective distances dictated thereby.

5. The apparatus of claim 1 further including:

adjustment means for adjusting the said first and second relative active lengths of respectively said strip and said strap to dictate said hybrid coefficient of thermal expansion.

6. The apparatus of claim 1 further including:

at least one anchor bracket on said frame assembly; and an adjustment screw engaged with said anchor bracket and said composite thermal compensation arm device and operative to displace said composite thermal compensation arm device relative to said frame assembly.

7. The apparatus of claim 1, wherein:

said strip and strap are formed with a plurality of spaced apart bores along the respective longitudinal lengths thereof and further including;

a control screw engageable with the respective said bores to dictate said hybrid coefficient of thermal expansion.

8. The apparatus of claim 1, wherein:

said strip is formed of nylon; and said strap is formed of metal.

9. The apparatus of claim 1, wherein:

said thermal compensation arm device comprises a composite arm device having a hybrid coefficient of thermal expansion, said composite arm device comprising an elongated metal strap formed with a plurality of spaced apart bores and an elongated strip of nylon formed with a channel for telescopic receipt therein of said strap, said strip being formed with a plurality of spaced apart bores for adjustable engagement of said strip and strap to dictate said hybrid coefficient of thermal expansion of said composite arm device.

10. In a display apparatus having a frame, a drive assembly, a moveable mosaic sheet, and a mask sheet disposed in floating and overlying relationship on said mosaic sheet, said mosaic sheet having a predetermined coefficient of thermal expansion such that selected portions of said mosaic sheet are caused to be moved through a predetermined path in response to a predetermined temperature differential, a thermal compensation device comprising:

at least one elongated thermal compensation arm anchoring said mask sheet to said frame, said thermal compensation arm including an elongated strip having a first relative active length and a first coefficient of thermal expansion and an elongated strap having a second relative active length and a second coefficient of thermal expansion, said elongated strip and elongated strap being telescopically connected together such that a hybrid coefficient of thermal expansion results sufficient to cause said arm to change in length in response to exposure to said predetermined temperature differential, shifting said mask sheet relative to said mosaic sheet through a compensation path corresponding to said predetermined path to maintain said selected portions of said mosaic sheet in accurate registration with corresponding portions of said mask sheet.

11. The display apparatus with the thermal compensation device of claim 10, wherein:

said elongated strap comprises a metallic strap and said elongated strip comprises a nylon strip, said metallic strap and nylon strip connected together telescopically to form proportionate portions of an overall length.

12. The display apparatus with the thermal compensation device of claim 10, wherein:

said at least one thermal compensation arm comprises a first thermal compensation arm; and further including;

a second thermal compensation arm spaced apart from said first thermal compensation arm for connection with said mask sheet at spaced apart locations to, upon exposure to said predetermined temperature differential, cause said spaced apart locations to be moved relative to said frame respective distance dictated thereby.

13. The display apparatus with the thermal compensation device of claim 10, further including:

adjustment means for adjusting the respective said first and second relative active lengths of said strip and said strap.

14. The display apparatus with the thermal compensation device of claim 10, further including:

at least one anchor bracket on said frame; and an adjustment screw engaged with said bracket and said thermal compensation arm and operative to displace said thermal compensation arm relative to said frame.

15. The display apparatus with the thermal compensation device of claim 10, wherein:

said strip and strap have respective first and second longitudinal lengths with a plurality of spaced apart bores along said respective longitudinal lengths thereof, and further including:

a control screw engageable with respective said bores to permit telescopic joining of said strip and strap at various points corresponding to said spaced apart bores, such that said hybrid coefficient of thermal expansion may be adjusted.

16. The display apparatus with the thermal compensation device of claim 10, wherein:

said strip is formed of nylon; and said strap is formed of metal with a predetermined coefficient of thermal expansion.

17. The display apparatus with the thermal compensation device of claim 10, wherein:

said thermal compensation arm comprises an elongated metal strap formed with a plurality of spaced apart bores and an elongated nylon strip formed with a channel for telescopic receipt therein of said metal strap, said strip being formed with a plurality of spaced apart bores for adjustable engagement of said strip and strap to dictate said hybrid coefficient of thermal expansion of said thermal compensation arm.

18. The display apparatus with the thermal compensation device of claim 10, wherein:

said thermal compensation arm includes a plastic arm formed with a longitudinal open-sided groove, an elongated metal strap arranged in telescopic relationship with said plastic arm and nested in said groove, and an adjustment pin device for mechanically locking said plastic arm and metal strap together at different selected locations along the length thereof to incorporate selected different lengths of said plastic arm and strap in active thermally-expansive operation between said frame and said mask sheet.

19. In a display apparatus having a frame, a drive assembly, a moveable mosaic sheet, and a mask sheet disposed in floating and overlying relationship on said mosaic sheet, said mosaic sheet having a predetermined coefficient of thermal expansion such that selected portions of said mosaic sheet are caused to be moved through a predetermined path in response to a predetermined temperature differential, a thermal compensation device comprising:

at least one elongated thermal compensation arm anchoring said mask sheet to said frame, said thermal compensation arm so arranged and having a predetermined coefficient of thermal expansion sufficient to cause said thermal compensation arm device to change in length in response to exposure to said predetermined temperature differential, shifting said mask sheet relative to said mosaic sheet through a compensation path corresponding to said predetermined path to maintain said selected portions of said mosaic sheet in accurate registration with corresponding portions of said mask sheet;

said thermal compensation arm includes an elongated strip having a first predetermined coefficient of thermal expansion and a first active length and an elongated strap having a second coefficient of thermal expansion and a second active length, said elongated strip and said elongated strap telescopically connected together to provide a composite thermal compensation arm having a hybrid coefficient of thermal expansion; and;

an adjustment means for adjusting the respective said first and second active lengths of said elongated strip and said elongated strap.

20. The display apparatus with the thermal compensation device of claim 19, wherein:

said strip and strap are formed with a plurality of spaced apart bores along the respective longitudinal lengths thereof and further including:

a control screw engageable with the respective said bores to dictate said hybrid coefficient of thermal expansion.

21. The display apparatus with the thermal compensation device of claim 19, wherein:

said strip is formed of nylon; and said strap is formed of metal with a predetermined coefficient of thermal expansion.

22. A display apparatus for sequentially displaying images and comprising:

sets of image pixels corresponding with discrete images interlaced on a transparent mosaic sheet though an aperture pattern comprising a plurality of uniformly spaced apart apertures formed in a substantially opaque mask sheet wherein one of said sheets comprises a moveable sheet mountable by at least one selected point to a drive assembly and having a coefficient of thermal expansion such that at least a portion thereof in response to exposure to predetermined temperature differentials will move through a temperature-induced path relative to the other of said sheets and said other of said sheets comprising a generally stationary sheet;

a frame assembly;

said drive assembly being mounted on said frame assembly, and operative to displace said moveable sheet through a predetermined travel path relative to said generally stationary sheet to sequentially align said sets of image pixels with said aperture pattern;

at least one elongated thermal compensation arm device including a first end engaged with said frame assembly and a second end formed for releasable engagement with said generally stationary sheet, said arm device being responsive to said predetermined temperature differentials to cause said at least said portion of said generally stationary sheet to be shifted by said arm device through a path corresponding to said predetermined temperature-induced path to maintain said mask sheet and said mosaic sheet in proper relative positions for continued sequential alignment of said sets of image pixels with said aperture pattern; and said arm device includes an elongated strip having a first coefficient of thermal expansion and elongated strap having a second coefficient of thermal expansion telescopically connected together to form a composite arm device with a hybrid coefficient of thermal expansion.

23. A display apparatus for displaying a series of images, comprising:

discrete image pixels interlaced on a transparent mosaic sheet registered against an aperture pattern formed in a substantially opaque mask sheet such that said pixels corresponding to a single image are displayed while said pixels corresponding to other images are hidden, one of said sheets being moveable about a predetermined operational path relative to other of said sheets, said other sheet being stationary, said moveable sheet being sensitive to temperature differentials such that at least a portion of said moveable sheet is caused to deviate from said predetermined operational path and instead follow a predetermined deflection path in response to exposure to a predetermined temperature differential, said moveable sheet mounted to and driven along said predetermined operational path by a drive assembly mounted on a frame assembly;

at least one elongated thermal compensation arm device including an elongated strip of a first predetermined length and an elongated strap of a second predetermined length, said elongated strip and said elongated strap telescopically connected such that a composite thermal compensation arm device of an adjustable length is formed, and also having a first end attached to said frame assembly and a second end attached to said stationary sheet, said arm device formed of a material with a predetermined coefficient of thermal expansion and responsive to said predetermined temperature differential such that at least a portion of said stationary sheet is caused to adjust its position along a path corresponding to said predetermined deflection path such that said pixels on said mosaic sheet are able to maintain proper alignment with said apertures on said mask sheet.

24. The display apparatus of claim 23, wherein;

said elongated strip is formed of a first material having a first predetermined coefficient of thermal expansion and said elongated strap is formed of a second material having a second predetermined coefficient of thermal expansion such that said composite thermal compensation arm device has a predetermined hybrid coefficient of thermal expansion.

25. The display apparatus of claim 24, wherein;

said elongated strip is formed of nylon; and said elongated strap is formed of metal.

26. The display apparatus of claim 23, further including:

a second thermal compensation arm device attached to said stationary sheet and said frame assembly in spaced apart relation to said at least one thermal compensation arm device such that a second portion of said stationary sheet is also adjusted along a path corresponding to said predetermined deflection path.

27. The display apparatus of claim 23, further including:

adjustment means for adjusting the length of said composite thermal compensation arm device by releasably connecting said elongated strip and said elongated strap at any of at least two points.

28. A display apparatus comprising:

a frame assembly;

a drive assembly mounting a mosaic sheet having a predetermined coefficient of thermal expansion to cause selected portions of said mosaic sheet to be moved through a predetermined path in response to predetermined temperature differentials;

a mask sheet disposed in floating and overlying relationship over said mosaic sheet;

at least one thermal compensation arm device anchoring said mask sheet to said frame assembly, said thermal compensation arm device so arranged and having a coefficient of thermal expansion sufficient to cause said thermal compensation arm device to, when said display apparatus is exposed to said predetermined temperature differential, change its length and shift said mask sheet relative to said mosaic sheet through a compensation path corresponding to said predetermined path to maintain said selected portions of said mosaic sheet in registration with the corresponding portions of said mask sheet;

said thermal compensation arm device includes an elongated strip of nylon having first coefficient of thermal expansion and a first relative active length and an elongated strap of metal of a second coefficient of thermal expansion and a second relative active length connected together to provide a composite thermal compensation device with a hybrid coefficient of thermal expansion, said elongated strip of nylon and said elongated strap of metal formed with a plurality of spaced apart bores along the respective longitudinal lengths thereof, said elongated strip of nylon formed with a channel for telescopic receipt therein of said elongated strap of metal;

adjustment means for adjusting the relative active lengths of said strip and strap; and a control screw engageable with the respective said bores to dictate said hybrid coefficient of thermal expansion.

* * * * *